US006726532B2

(12) United States Patent
Lin et al.

(10) Patent No.: US 6,726,532 B2
(45) Date of Patent: Apr. 27, 2004

(54) BELT TENSIONING ASSEMBLY FOR CMP APPARATUS

(75) Inventors: Hun Lin, Hualien (TW); Tien-Chen Hu, Pingtung (TW); Tso-Hsu Lin, Taichung (TW); Hong-Chin Pu, Pingtung (TW); Jeng-Fang Chang, Pingtung (TW); Der-Yuan Hong, Tainan (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 10/202,196

(22) Filed: Jul. 24, 2002

(65) Prior Publication Data

US 2004/0018808 A1 Jan. 29, 2004

(51) Int. Cl.[7] ..... B24B 21/00

(52) U.S. Cl. ..... 451/28; 451/56; 451/302; 451/297; 451/311; 474/138; 474/134; 198/813

(58) Field of Search ..... 451/311, 56, 5, 451/4, 302, 297; 198/813; 474/134, 133, 135, 136, 137, 138, 117, 114

(56) References Cited

U.S. PATENT DOCUMENTS 4,416,647 A * 11/1983 White, Jr. ..... 474/134
4,908,006 A * 3/1990 Burysek et al. ..... 474/117
5,049,114 A * 9/1991 Hayden ..... 474/111
5,871,390 A * 2/1999 Pant et al. ..... 451/5
6,273,796 B1 * 8/2001 Moore ..... 451/56
6,428,404 B2 * 8/2002 Walker et al. ..... 451/311
6,482,072 B1 * 11/2002 Gurusamy et al. ..... 451/4
6,500,056 B1 * 12/2002 Krusell et al. ..... 451/302
6,537,142 B2 * 3/2003 Liou ..... 451/311
6,544,112 B1 * 4/2003 Fuchs ..... 451/297
6,561,884 B1 * 5/2003 White et al. ..... 451/66

FOREIGN PATENT DOCUMENTS

GB 2143492 * 2/1985 ..... 198/813

* cited by examiner

*Primary Examiner*—George Nguyen
(74) *Attorney, Agent, or Firm*—Tung & Associates

(57) ABSTRACT

A tensioning assembly for a polishing belt on a linear chemical mechanical polishing apparatus. The tensioning assembly comprises first and second rollers which are operably engaged by respective air cylinders and exert a selected degree of downward tension on the lower run of the horizontal polishing belt. A third roller biased typically by a spring pushes upwardly on the lower run of the belt between the first and second rollers. Accordingly, the first and second rollers, in conjunction with the third roller, tension the belt on the apparatus to maintain optimum material removal rates and uniformity. The degree of tension exerted on the belt can be varied according to stretching of the belt resulting from prolonged use.

20 Claims, 3 Drawing Sheets

BELT TENSIONING ASSEMBLY FOR CMP APPARATUS

FIELD OF THE INVENTION

The present invention relates to chemical mechanical polishing apparatus used in the polishing of semiconductor wafers. More particularly, the present invention relates to an assembly for tensioning a polishing belt on a CMP apparatus to prevent deformation of the belt through prolonged use.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shadow trench isolation (STI) layer, inter-layer dielectric (ILD) or on an inter-metal dielectric (IMD) layer, which are frequently used in memory devices. The planarization process is important since it enables the subsequent use of a high-resolution lithographic process to fabricate the next-level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing, or CMP. The process has been widely used on ILD or IMD layers in fabricating modern semiconductor devices. A CMP process is performed by using a rotating platen in combination with a pneumatically-actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen, with a resilient layer as an outer layer of the pad. The layers are typically made of a polymeric material such as polyurethane and may include a filler for controlling the dimensional stability of the layers. A polishing pad is typically made several times the diameter of a wafer in a conventional rotary CMP, while the wafer is kept off-center on the pad in order to prevent polishing of a non-planar surface onto the wafer. The wafer itself is also rotated during the polishing process to prevent polishing of a tapered profile onto the wafer surface. The axis of rotation of the wafer and the axis of rotation of the pad are deliberately not collinear; however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 A and about 10,000 A. The uniformity requirement for ILD or IMD polishing is very stringent since non-uniform dielectric films lead to poor lithography and resulting window-etching or plug-formation difficulties. The CMP process has also been applied to polishing metals, for instance, in tungsten plug formation and in embedded structures. A metal polishing process involves a polishing chemistry that is significantly different than that required for oxide polishing.

Important components used in CMP processes include an automated rotating polishing platen and a wafer holder, which both exert a pressure on the wafer and rotate the wafer independently of the platen. The polishing or removal of surface layers is accomplished by a polishing slurry consisting mainly of colloidal silica suspended in deionixed water or KOH solution. The slurry is frequently fed by an automatic slurry feeding system in order to ensure uniform wetting of the polishing pad and proper delivery and recovery of the slurry. For a high-volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in controlling polishing rates at different locations on a wafer surface. Since the polishing rate applied to a wafer surface is generally proportional to the relative rotational velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated for by rotating the wafer surface during the polishing process such that a uniform average polishing rate can be obtained, the wafer surface, in general, is exposed to a variable polishing rate during the CMP process.

Recently, a chemical mechanical polishing method has been developed in which the polishing pad is not moved in a rotational manner but instead, in a linear manner. It is therefore named as a linear chemical mechanical polishing process, in which a polishing pad is moved in a linear manner in relation to a rotating wafer surface. The linear polishing method affords a more uniform polishing rate across a wafer surface throughout a planarization process for the removal of a film layer from the surface of a wafer. One added advantage of the linear CMP system is the simpler construction of the apparatus, and this not only reduces the cost of the apparatus but also reduces the floor space required in a clean room environment.

A typical linear CMP apparatus 10 is shown in FIGS. 1A and 1B. The linear CMP apparatus is utilized for polishing a semiconductor wafer 24, i.e., a silicon wafer in removing a film layer of either an insulating material or a conductive material from the wafer surface. For instance, the film layer to be removed may include insulating materials such as silicon oxide, silicon nitrite or spin-on-glass material or a metal layer such as aluminum, copper or tungsten. Various other materials such as metal alloys or semi-conducting materials such as polysilicon may also be removed.

As shown in FIGS. 1A and 1B, the wafer 24 is mounted on a rotating platform, or wafer holder 18, which rotates at a predetermined speed. The major difference between the conventional linear CMP apparatus 10 and the predecessor CMP apparatus (not illustrated) is that a continuous, or endless, polishing belt 12 is utilized instead of a rotating polishing pad. The polishing belt 12 moves in a linear, rather than rotational, manner in respect to the rotational surface of the wafer 24. The linear polishing belt 12 is mounted in a continuous manner over an idle roller 15 and a drive roller 14, which is driven by a motor (not shown) at a predetermined rotational speed. The rotational motion of the drive roller 14 and idle roller 15 is transformed into a linear motion 26 in respect to the surface of the wafer 24. This is shown in FIG. 1B.

In the conventional linear CMP apparatus 10, one or more polishing pads 30 are adhesively joined to the continuous polishing belt 12 on its outer surface that faces the wafer 24. A polishing assembly 38 is thus formed by the continuous polishing belt 12 and the polishing pad 30 glued or otherwise attached thereto. As shown in FIG. 1A, a plurality of polishing pads 30 are typically utilized and which are frequently supplied in rectangular-shaped pieces with a pressure-sensitive layer coated on the back side.

The wafer platform 18 and the wafer 24 forms an assembly of a wafer carrier 28 on the conventional linear CMP apparatus 10. The wafer 24 is normally held in position by a mechanical retainer, commonly known as a retaining ring 16, as shown in FIG. 1B. The major function of the retaining ring 16 is to fix the wafer 24 in position in the wafer carrier 28 during the linear polishing process and thus, prevent the wafer 24 from moving horizontally as wafer 24 contacts the polishing pad 30. The wafer carrier 28 is normally operated in a rotational mode such that a more uniform polishing on the wafer 24 can be achieved. To further improve the uniformity of linear polishing, a support housing 32 is further utilized to provide support to a support platen 22 during a polishing process. The support platen 22 provides a supporting platform for the underside of the continuous polishing belt 12 to ensure that the polishing pad 30 makes sufficient contact with the surface of the wafer 24 in order to achieve more uniform material removal from the surface layer of the wafer 24. Typically, the wafer carrier 28 is pressed downwardly against the continuous polishing belt 12 and the polishing pad 30 at a predetermined force such that a suitable polishing rate on the surface of the wafer 24 can be obtained. Air pressure is typically further used to push the support platen 22 upwardly against the polishing belt 12 which, in turn, pushes the polishing pad or pads 30 against the wafer 24. A desirable polishing rate on the wafer surface can therefore by obtained by suitably adjusting the downward force on the wafer carrier 28, the upward air pressure against the support platen 22, and the linear speed 26 of the polishing pad 30. A slurry dispenser 20 is further utilized to dispense a slurry solution 34 onto the polishing pad or pads 30. An air cylinder 34 may be connected to the idle roller 15 through a tensioning shaft 36 to facilitate positioning of the idle roller 15 along a horizontal axis and tightening of the polishing belt 12 on the drive roller 14 and idle roller 15.

A common problem associated with the conventional CMP apparatus 10 is that the polishing belt 12 eventually stretches and becomes deformed through prolonged use, as shown in FIG. 2, due to the constant tension exerted on the polishing belt 12 by the support platen 22, wafer holder 18 and idle roller 15. This adversely affects the rate of removal of copper from the semiconductor wafer 24, as well as the removal uniformity, during the CMP process. Consequently, the polishing belt 12 must be frequently replaced, and this requires excessive manpower and costs for preventative maintenance. Accordingly, a device is needed for exerting tension on a polishing belt for a CMP apparatus in order to compensate for enlargement of the belt as a result of prolonged use and maintain proper tension on the belt for effective and uniform polishing of semiconductor wafers.

An object of the present invention is to provide a tensioning assembly for tensioning a polishing belt on a chemical mechanical polisher.

Another object of the present invention is to provide a tensioning assembly which exerts a selected degree of tension on a polishing belt of a chemical mechanical polisher in order to compensate for gradual enlargement and loosening or slackening of the belt resulting from prolonged usage.

Still another object of the present invention is to provide a tensioning assembly which reduces manpower and costs associated with periodic maintenance of chemical mechanical polishers.

Yet another object of the present invention is to provide a tensioning assembly which extends the useful lifetime of a polishing belt in a chemical mechanical polisher.

Still another object of the present invention is to provide a tensioning assembly which contributes to enhanced rates of removal of material from semiconductor wafers by maintaining tension on a polishing belt of a chemical mechanical polishing apparatus.

A still further object of the present invention is to provide a tensioning assembly which facilitates uniform and stable copper removal rates using a polishing belt on a chemical mechanical polisher over prolonged use of the polishing belt.

Yet another object of the present invention is to provide a tensioning assembly for a polishing belt on a chemical mechanical polisher, which tensioning apparatus is capable of applying variable tension on the polishing belt depending upon the slack in the polishing belt in order to achieve uniform and optimum removal of copper or other materials from a semiconductor wafer during a CMP process.

SUMMARY OF THE INVENTION

In accordance with these and other objects and advantages, the present invention comprises a tensioning assembly for a polishing belt on a linear chemical mechanical polishing apparatus. The tensioning assembly comprises first and second rollers which are operably engaged by respective air cylinders and exert a selected degree of downward tension on the lower run of the horizontal polishing belt. A third roller biased typically by a spring pushes upwardly on the lower run of the belt between the first and second rollers. Accordingly, the first and second rollers, in conjunction with the third roller, tension the belt on the apparatus to maintain optimum material removal rates and uniformity. The degree of tension exerted on the belt can be varied according to stretching of the belt resulting from prolonged use.

BRIEF DESCRIPTION OF THE DRAWINGS

The invention will now be described, by way of example, with reference to the accompanying drawings, in which.

DESCRIPTION OF THE PREFERRED EMBODIMENTS

The belt tensioning assembly of the present invention has particularly beneficial utility in the tensioning of a polishing belt in a chemical mechanical polishing apparatus. However, the invention is not so limited in application, and while references may be made to such chemical mechanical polishing apparatus, the invention is more generally applicable to tensioning belts in a variety of industrial and mechanical applications.

Figure 1A:
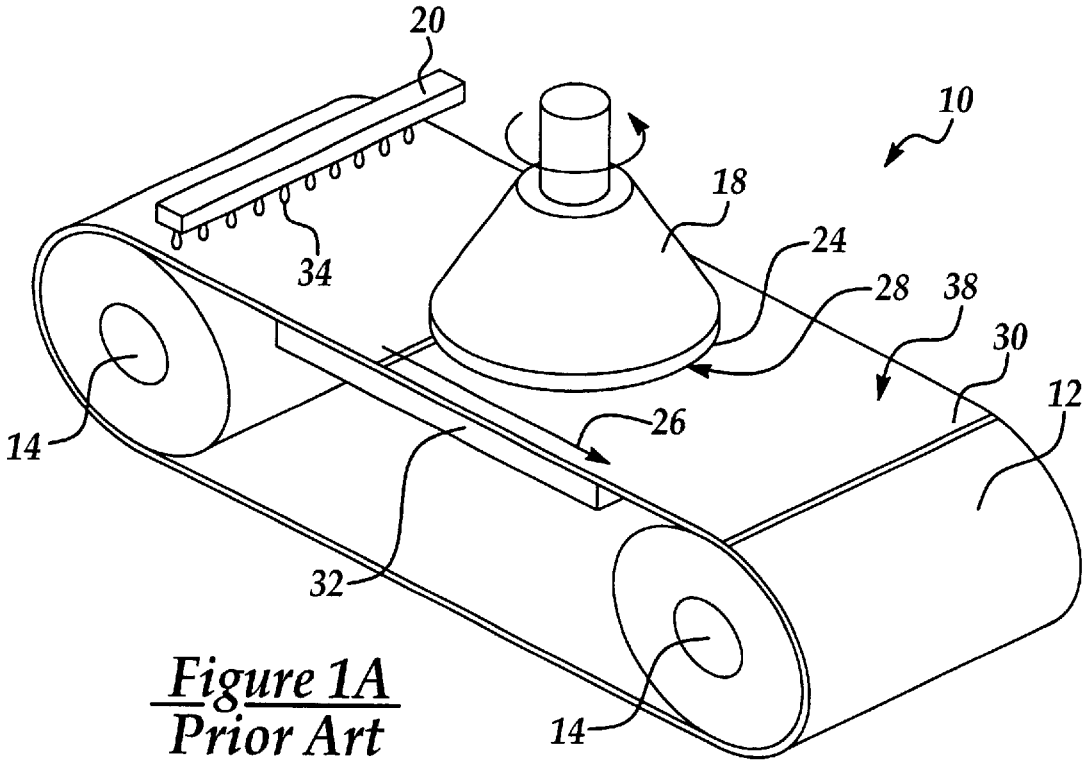
Figure 1A Prior Art
FIG. 1A is a perspective view of a typical conventional chemical mechanical polishing apparatus.
Figure 1B:
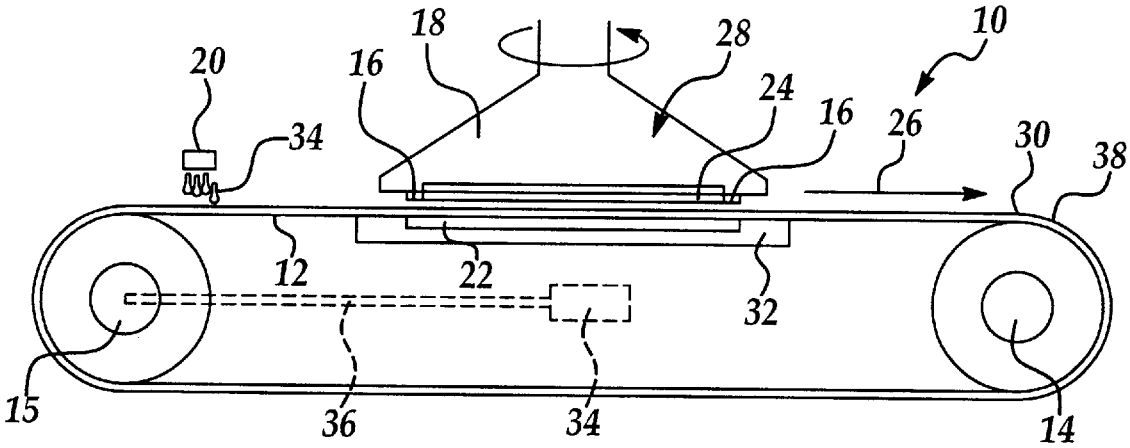
Figure 1B Prior Art
FIG. 1B is a side view of a typical conventional chemical mechanical polishing apparatus.
Figure 2:
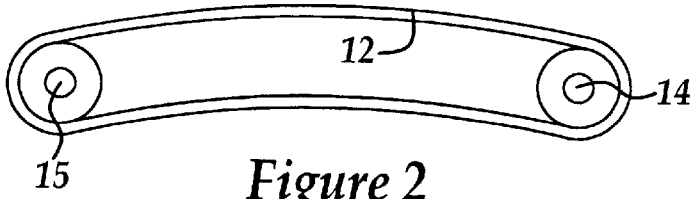
Figure 2 Prior Art
FIG. 2 illustrates typical stretching and deformation of a polishing belt on a chemical mechanical polishing apparatus as a result of prolonged use of the belt.
Figure 3:
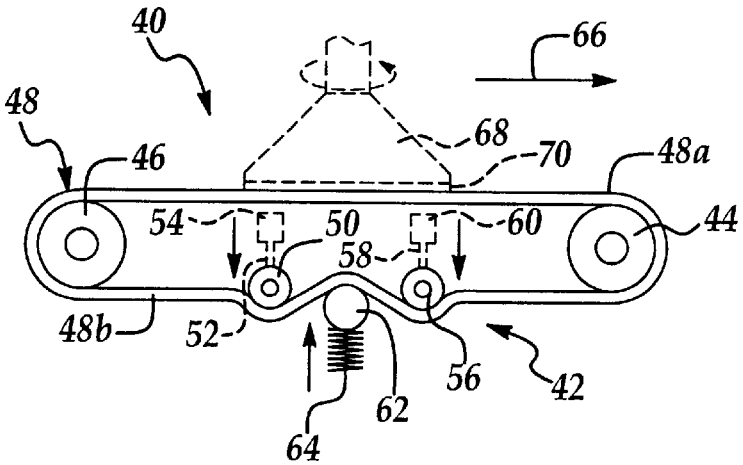
FIG. 3 illustrates a tensioning assembly of the present invention.

Referring next to FIG. 3, an illustrative embodiment of the belt tensioning assembly of the present invention is generally indicated by reference numeral 42. The belt tensioning assembly 42 is mounted on a linear CMP apparatus 40 such as a Lam CMP apparatus manufactured by the Lam Research Corp. of Fremont Calif., for example, for tensioning a continuous polishing belt 48 which traverses a drive roller 44 and an idle roller 46 on the linear CMP apparatus 40. The drive roller 44 and the idle roller 46 define an upper horizontal run 48*a* and a lower horizontal run 48*b* in the continuous polishing belt 48. The belt tensioning assembly 42 includes an idle end tensioning roller 50 which is located in spaced proximity to the idle roller and engages the inner surface of the lower horizontal run 48*b* of the polishing belt 48. The idle end tensioning roller 50 is mounted on the lower end of a shaft 52 which is selectively extendible from a hydraulic or pneumatic cylinder 54. A drive end tensioning roller 56 is located in spaced proximity to the drive roller 44 and, like the idle end tensioning roller 50, engages the inner surface of the lower horizontal run 48*b* of the polishing belt 48. The drive end tensioning roller 56 is mounted on the lower end of a shaft 58 which is selectively extendible from a hydraulic or pneumatic cylinder 60. A static tensioning roller 62, upwardly biased typically by a roller tensioning spring 64, engages the outer surface of the lower belt run 48*b*, between the idle end tensioning roller 50 and the drive end tensioning roller 56. While the static tensioning roller 62, biased by the roller tensioning spring 64, exerts an upward static force of typically about 1 lb. against the outer surface of the polishing belt 48, the idle end tensioning roller 50 and drive end tensioning roller 56 is each capable of exerting a selected pressure of typically from about 20 psi to about 100 psi, and preferably, about 40–60 psi, against the inner surface of the polishing belt 48.

In application, the CMP apparatus 40 is operated to remove copper or other material from a semiconductor wafer 70 mounted on a wafer holder 68 of the CMP apparatus 40. Accordingly, as the polishing belt 48 is driven on the drive roller 44 and the idle roller 46 at a desired linear speed in the direction indicated by the arrow 66, the wafer holder 68 rotates the wafer 70 against polishing pads (not illustrated) attached to the outer surface of the moving polishing belt 48. The idle end tensioning roller 50 and the drive end tensioning roller 56 each exerts a downward pressure against the polishing belt 48. Consequently, the lower horizontal run 48*b* of the polishing belt 48 is crimped by the idle end tensioning roller 50, the static tensioning roller 62 and the drive end tensioning roller 56, as illustrated. This crimped configuration tends to tighten the polishing belt 48 on the drive roller 44 and the idle roller 46, and the upper run 48*a* of the polishing belt 48 is thus maintained at a sufficiently tight configuration for optimal polishing rates and uniformity in the polishing of a copper layer, for example, from the semiconductor wafer 70 as the drive roller 44 drives the polishing belt 48 along the linear motion 66. The downward pressure exerted on the polishing belt 48 by the idle end tensioning roller 50 and the drive end tensioning roller 56, and thus, the tension of the polishing belt 48, is increased as needed by extending the shaft 52 and shaft 58 from the cylinder 54 and cylinder 60, respectively. Conversely, the tension of the polishing belt 48 is decreased as needed by retracting the shaft 52 and shaft 58 into the cylinder 54 and cylinder 60, respectively, thereby decreasing the downward pressure exerted on the polishing belt 48 by the idle end tensioning roller 50 and the drive end tensioning roller 56, respectively. The downward pressure of the idle end tensioning roller 50 and the drive end tensioning roller 56 against the polishing belt 48 is typically between about 20 psi and about 100 psi, and preferably, between about 40 psi and about 60 psi. Over a period of prolonged usage, the polishing belt 48 tends to gradually lengthen and become slack due to the tension exerted thereon during the CMP process. Accordingly, the longer the length of the polishing belt 48, the greater the length of extension of the shaft 52 and the shaft 58 from the cylinder 54 and the cylinder 60, respectively, and the more compressed the roller tensioning spring 64 will become to maintain the desired tension on the polishing belt 48.

Figure 6:
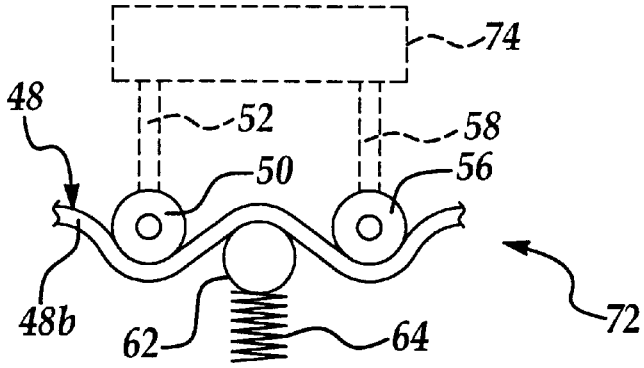
FIG. 6 illustrates another embodiment of the tensioning assembly of the present invention.

Referring next to FIG. 6, in another embodiment of the belt tensioning assembly indicated by reference numeral 72, the shaft 52 and shaft 58 are extendible from a common hydraulic or pneumatic cylinder 74, with the idle end tensioning roller 50 rotatably mounted on the bottom end of the shaft 52 and the drive end tensioning roller 56 rotatably mounted on the bottom end of the shaft 58. The static tensioning roller 62, upwardly biased by the roller tensioning spring 64, engages the outer surface of the lower run 48*b* of the polishing belt 48. Accordingly, the idle end tensioning roller 50 and the drive end tensioning roller 56 are pressed against the inner surface of the lower run 48*b* of the polishing belt 48 in order to tighten the polishing belt 48 by simultaneously extending the shaft 52 and shaft 58 from the cylinder 74. Conversely, the polishing belt 48 is loosened by retracting the shaft 52 and shaft 58 simultaneously into the cylinder 74, thereby reducing pressure of the idle end tensioning roller 50 and the drive end tensioning roller 56 against the polishing belt 48.

Figure 4:
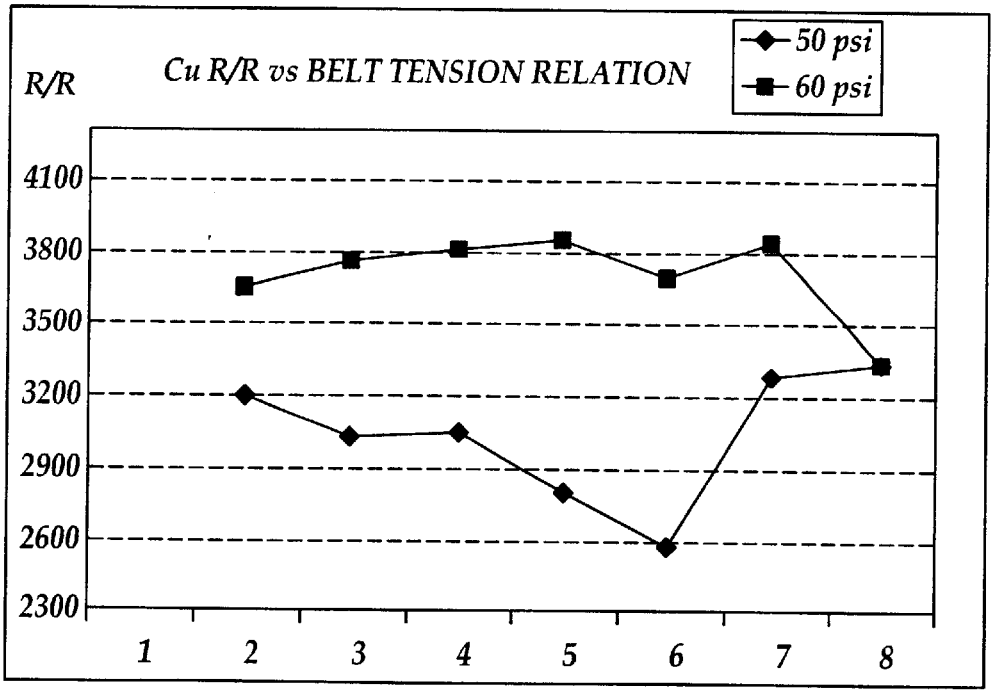
FIG. 4 is a graph which illustrates removal rate of copper from a wafer as a function of belt tension.

A graph illustrating rates of removal of copper from a semiconductor wafer as a function of tension in pounds per square inch applied the polishing belt of a CMP apparatus is illustrated in FIG. 4. Accordingly, copper removal rates using a polishing belt having a tension of 50 psi is represented by the connected diamonds and copper removal rates using a polishing belt having a tension of 60 psi is represented by the connected squares. It can be seen from the graph that copper removal rates using a polishing belt having a tension of 60 psi significantly enhances the rate of removal of copper from the wafer as compared to using a polishing belt having a tension of only 50 psi.

Figure 5:
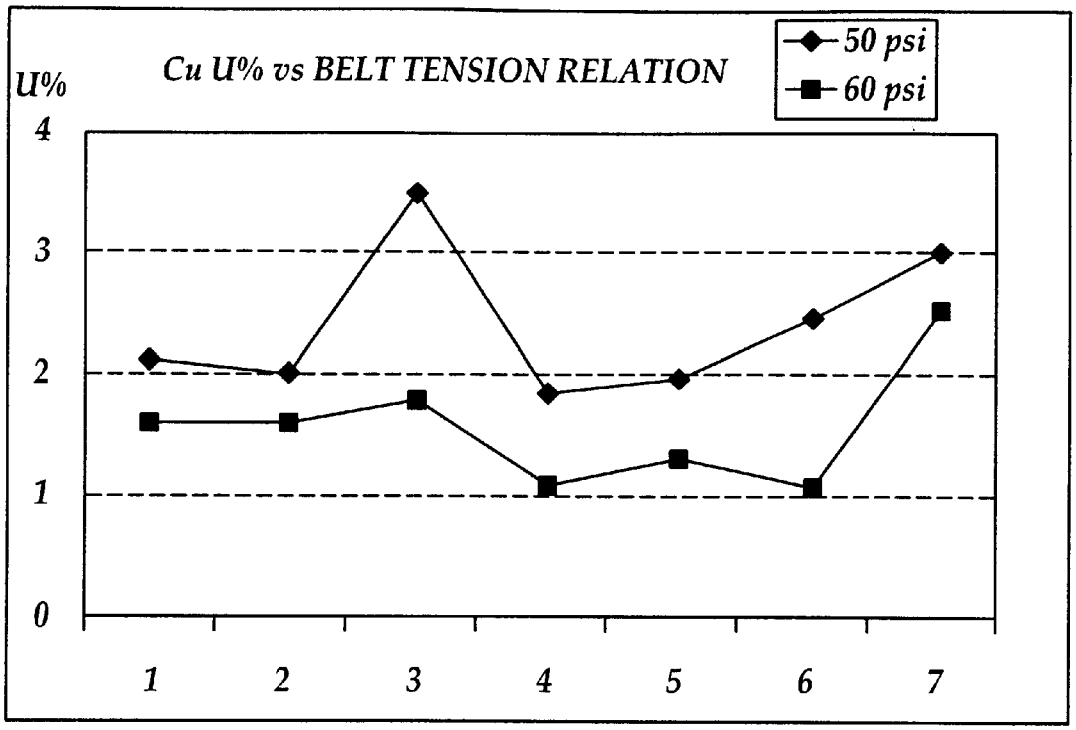
FIG. 5 is a graph which illustrates removal uniformity of copper from a wafer as a function of belt tension.

A graph illustrating uniformity in removal of copper from a semiconductor wafer as a function of tension in pounds per square inch applied the polishing belt of a CMP apparatus is illustrated in FIG. 5. In the graph, copper removal uniformity using a polishing belt having a tension of 50 psi is represented by the connected diamonds, whereas copper removal uniformity using a polishing belt having a tension of 60 psi is represented by the connected squares. It can be seen from the graph that copper removal uniformity using a polishing belt having a tension of 60 psi is more stable than copper removal uniformity using a polishing belt having a tension of 50 psi.

While the preferred embodiments of the invention have been described above, it will be recognized and understood that various modifications can be made in the invention and the appended claims are intended to cover all such modifications which may fall within the spirit and scope of the invention.

Having described our invention with the particularity set forth above, we claim:

What is claimed is:

1. A belt tensioning assembly for tensioning a continuous belt, comprising:

a first tensioning roller and a second tensioning roller spaced from said first tensioning roller for engaging a first surface of the belt;

a static tensioning roller for engaging a second surface of the belt between said first tensioning roller and said second tensioning roller; and a tensioning mechanism engaging said first tensioning roller and said second tensioning roller for pressing said first tensioning roller and said second tensioning roller against the belt.

2. The belt tensioning assembly of claim 1 further comprising a bias mechanism engaging said static tensioning roller for applying static tension to said static tensioning roller.

3. The belt tensioning assembly of claim 1 wherein said tensioning mechanism comprises a cylinder operably engaging said first tensioning roller and said second tensioning roller.

4. The belt tensioning assembly of claim 3 further comprising a bias mechanism engaging said static tensioning roller for applying static tension to said static tensioning roller.

5. The belt tensioning assembly of claim 2 wherein said bias mechanism comprises a roller tensioning spring.

6. The belt tensioning assembly of claim 5 wherein said tensioning mechanism comprises a cylinder operably engaging said first tensioning roller and said second tensioning roller.

7. The belt tensioning assembly of claim 3 wherein said cylinder comprises a pneumatic cylinder.

8. The belt tensioning assembly of claim 7 further comprising a bias mechanism engaging said static tensioning roller for applying static tension to said static tensioning roller.

9. The belt tensioning assembly of claim 8 wherein said bias mechanism comprises a roller tensioning spring.

10. The belt tensioning assembly of claim 3 wherein said cylinder comprises a hydraulic cylinder.

11. The tensioning assembly of claim 10 further comprising a bias mechanism engaging said static tensioning roller for applying static tension to said static tensioning roller.

12. The tensioning assembly of claim 11 wherein said bias mechanism comprises a roller tensioning spring.

13. A belt tensioning assembly for tensioning a continuous belt, comprising:

a first tensioning roller and a second tensioning roller spaced from said first tensioning roller for engaging and applying pressure against a first surface of the belt along a first axis of pressure;

a static tensioning roller for engaging and applying pressure against a second surface of the belt between said first tensioning roller and said second tensioning roller, along a second axis of pressure substantially parallel to said first axis of pressure; and a tensioning mechanism engaging said first tensioning roller and said second tensioning roller for pressing said first tensioning roller and said second tensioning roller against the belt.

14. The tensioning assembly of claim 13 further comprising a bias mechanism engaging said static tensioning roller for applying static tension to said static tensioning roller.

15. The tensioning assembly of claim 13 wherein said tensioning mechanism comprises a first pneumatic cylinder operably engaging said first tensioning roller and a second pneumatic cylinder operably engaging said second tensioning roller.

16. The tensioning assembly of claim 15 further comprising a bias mechanism engaging said static tensioning roller for applying static tension to said static tensioning roller.

17. A method of tensioning a continuous polishing belt on a chemical mechanical polishing apparatus, said method comprising:

providing a first tensioning roller and a second tensioning roller in engagement with a first surface of the belt in spaced-apart relationship to each other;

providing a static tensioning roller in engagement with a second surface of the belt between said first tensioning roller and said second tensioning roller;

providing a tensioning mechanism in engagement with said first tensioning roller and said second tensioning roller;

providing a bias mechanism in engagement with said static tensioning roller;

applying said static tensioning roller against the second surface of the belt at a static pressure and along an axis of static pressure by operation of said bias mechanism; and applying said first tensioning roller and said second tensioning roller against the first surface of the belt at a selected tensioning pressure and along an axis of tensioning pressure substantially parallel to said axis of static pressure by operation of said tensioning mechanism.

18. The method of claim 17 wherein said static pressure is about 1 lb.

19. The method of claim 17 wherein said selected tensioning pressure is about 20 psi to about 100 psi.

20. The method of claim 19 wherein said selected tensioning pressure is about 40 psi to about 60 psi.

* * * * *